United States Patent [19]

Rockwell

[11] Patent Number: 4,697,809

[45] Date of Patent: Oct. 6, 1987

[54] CABLE-OPERATED EXERCISER

[75] Inventor: Gary L. Rockwell, Auburn, Ala.

[73] Assignee: Diversified Products Corp., Opelika, Ala.

[21] Appl. No.: 788,144

[22] Filed: Oct. 16, 1985

[51] Int. Cl.[4] ..... A63B 21/06

[52] U.S. Cl. ..... 272/118; 272/134

[58] Field of Search ..... 272/117, 118, 123, 130–143, 272/DIG. 4

[56] References Cited

U.S. PATENT DOCUMENTS

| | | | |
|---|---|---|---|
| 403,703 | 5/1889 | Small . | |
| 676,771 | 6/1901 | Reach . | |
| 723,625 | 3/1903 | Thornley | 272/118 |
| 931,699 | 8/1909 | Medart . | |
| 1,052,962 | 2/1913 | Reach | 272/118 |
| 2,977,120 | 3/1961 | Morris | 272/118 |
| 3,746,338 | 7/1973 | Proctor . | |
| 3,840,227 | 10/1974 | Chesemore . | |
| 3,850,431 | 11/1974 | Winans . | |
| 3,905,599 | 9/1975 | Mazman . | |
| 4,199,139 | 4/1980 | Mahnke et al. | 272/118 |
| 4,390,179 | 6/1983 | Szkalak | 272/118 |
| 4,505,475 | 3/1985 | Olschansky et al. | 272/118 |

FOREIGN PATENT DOCUMENTS 1151656 5/1969 United Kingdom .

*Primary Examiner*—Richard J. Apley
*Assistant Examiner*—Robert W. Bahr
*Attorney, Agent, or Firm*—Banner, Birch, McKie & Beckett

[57] ABSTRACT

A cable-operated exercising apparatus having at least two mechanisms for lifting a downwardly biased, vertically guided carriage. At least one of the lifting mechanisms is a cable which is maintained taut when the carriage is lifted by the other lifting mechanism so as not to become entangled with the apparatus.

16 Claims, 5 Drawing Figures

CABLE-OPERATED EXERCISER

BACKGROUND OF THE INVENTION

The invention relates to physical exercising apparatus and, more particularly, to cable-operated exercising apparatus which affords a variety of weight training exercises.

Cable-operated weight training equipment is well-known in the exercise equipment art. Typically, such devices comprise a vertically guided, weight-laden carriage which is lifted by a user through an arrangement of pulleys and cables. Often it is desirable to make such equipment versatile for performing many different types of exercises by providing means for exerting exercise forces in many different directions. In equipment of this type, this typically is provided by upper and lower, and sometimes intermediate pulley positions. See, for example, Small U.S. Pat. No. 403,703; Medart U.S. Pat. No. 931,699; Morris U.S. Pat. No. 2,977,120; and Reach U.S. Pat. No. 676,771. In the devices disclosed in these patents, the weighted carriage itself has a pulley and is lifted by means of a cable trained around that and other pulleys, amounting to a traveling pulley system wherein only half the weight on the carriage is required as a pulling force to lift the carriage due to the mechanical advantage of the system. Accordingly, a relatively large stack of weights may be required to provide the requisite amount of resistance to exercise. An advantage of this system, however, is that a continous cable may be used extending from the upper pulley through the system to the lower pulley, with appropriate cable stops to anchor each end of the cable, so that virtually no reconfiguration of the equipment is required for changeover from an upper pulling machine to a lower pulling machine. However, as noted above, a large quantity of weight may be required for proper effort level.

Chesemore U.S. Pat. No. 3,840,227; Winans U.S. Pat. No. 3,850,431; Szkalak U.S. Pat. No. 4,390,179; and Mazman U.S. Pat. No. 3,905,599 disclose exercise devices wherein the stack of weights may be lifted by any one of a number of mechanisms, thereby affording a variety of exercises. In each of these devices, the weights themselves are lifted by a cable which is attached directly to the weighted carriage (without a traveling pulley), thereby applying the full load to the cable and minimizing the amount of weight required for a full range of exercise loads. In the Chesemore, Winans and Szkalak devices, however, a change from one lifting mechanism to another requires reconfiguration or reconnection of the cable or cables in different ways. In the Mazman device, the overhead cable arrangement must be reconnected when it is to be used or, if left connected with its overhead handle in place, will move when the alternate handle is used for exercises, resulting in a drop of the overhead cable-attached handle, possibly interfering with the exercise. If the overhead handle in the Mazman device were somehow immobilized, the resulting slack in the cable might cause it to foul with the other working parts of the apparatus.

SUMMARY OF THE INVENTION

It is, therefore, an object of the invention to provide a cableoperated exercise device which is simple in construction and operation, requires a minimum amount of weight or resistance to achieve desired effort levels, and does not require reconfiguration or reconnection of the working parts of the device to change from one mode of operation to another, or undesirable movement of portions of the device during exercise.

Another object of the invention is to prvide such an exerciser wherein the unused lifting cable will not slacken and possibly foul in the equipment when the carriage is raised by the other lifting means.

Another object of the invention is to provide such an exerciser wherein the unused lifting cable remains stationary during use of the other lifting means so that any handles or other attachments connected to the cable will not interfere with the user's performance of exercises.

These and other objects of the invention are accomplished by providing a physical exercising apparatus comprising a liftable carriage, vertically extending carriage guide means for guiding the movement of the carriage, resistance means operatively connected to the carriage downwardly biasing and resisting lifting movement of the carriage, and a plurality of alternately useable lifting means operatively connected to the carriage for lifting the carriage against the resistance means. At least one of the lifting means comprises a cable having an inner end operatively connected to the carriage, an outer end to which a lifting force can be applied by a user, and an intermediate portion between the inner and outer ends. Upper cable guide means adjacent the top of the carriage guide means guides the cable and defines therebeneath a vertical run of the cable along its intermediate portion. Outer cable stop means is provided on the cable for limiting downward movement of the cable along the vertical run. Cable tensioning means is connected to the inner end of the cable for tensioning and arresting the vertical run of the cable during lifting and lowering of the carriage by another of the lifting means. Carriage engaging means is provided on the inner end of the cable for engaging and lifting the carriage when a lifting force is applied to the outer end of the cable, and allowing the carriage to freely move past the stationary vertical run of the cable when the carriage is lifted by another of the lifting means.

The lifting means may comprise a pair of cables of the same type, in which case the vertical run of one cable remains stationary and taut during lifting by the other cable, and vice versa. Alternate lifting means also may include, for example, a handle directly connected to the carriage, the cable remaining stationary and taut during lifting of the carriage by the handle. The resistance means may comprise a stack of selectable weights, springs or any other suitable means for downwardly biasing the carriage.

BRIEF DESCRIPTION OF THE DRAWINGS

The invention is diagrammatically illustrated, by way of example, in the accompanying drawings in which.

DETAILED DESCRIPTION

Figure 1:
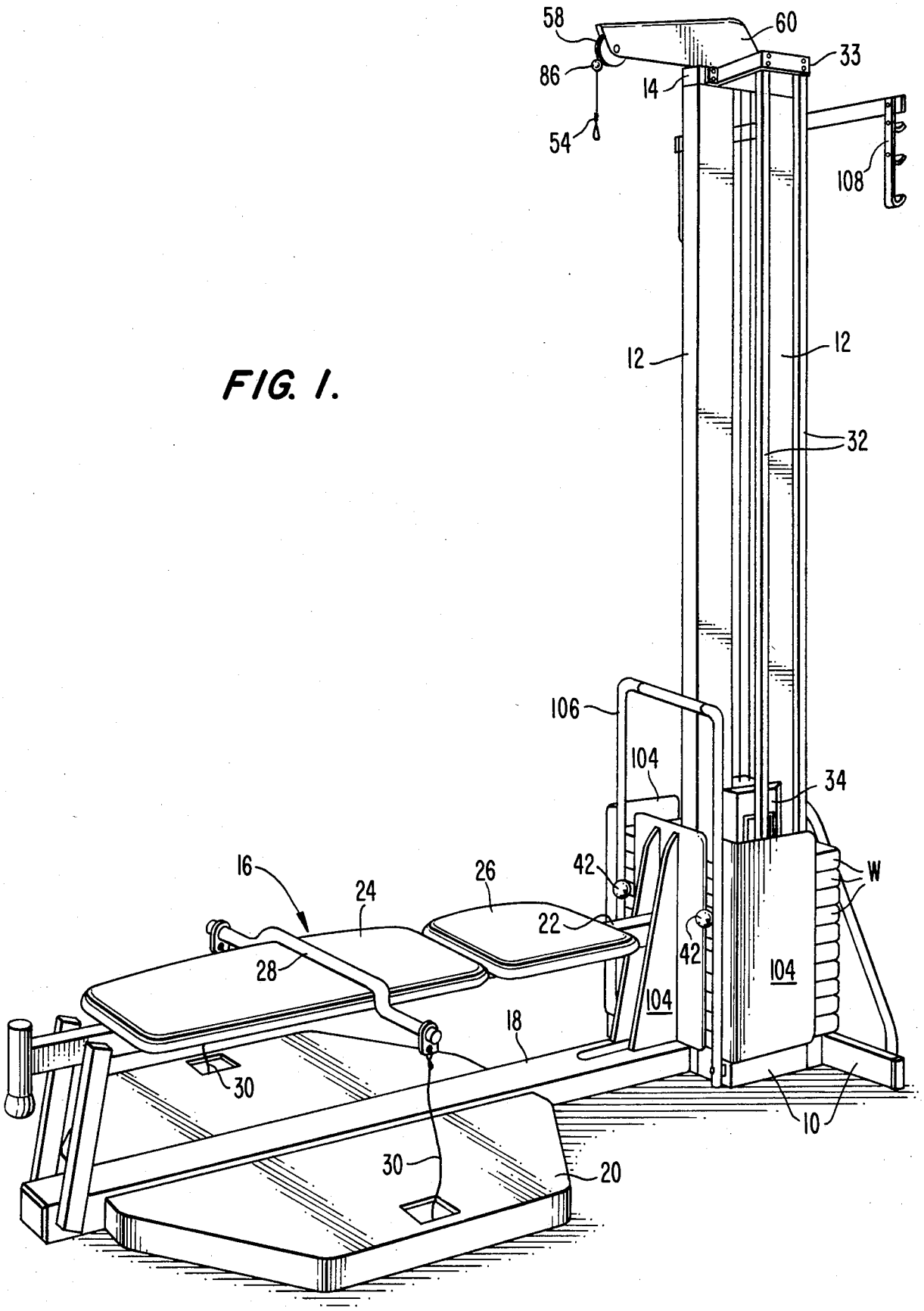
FIG. 1 is a perspective view of the apparatus according to the invention.
Figure 2:
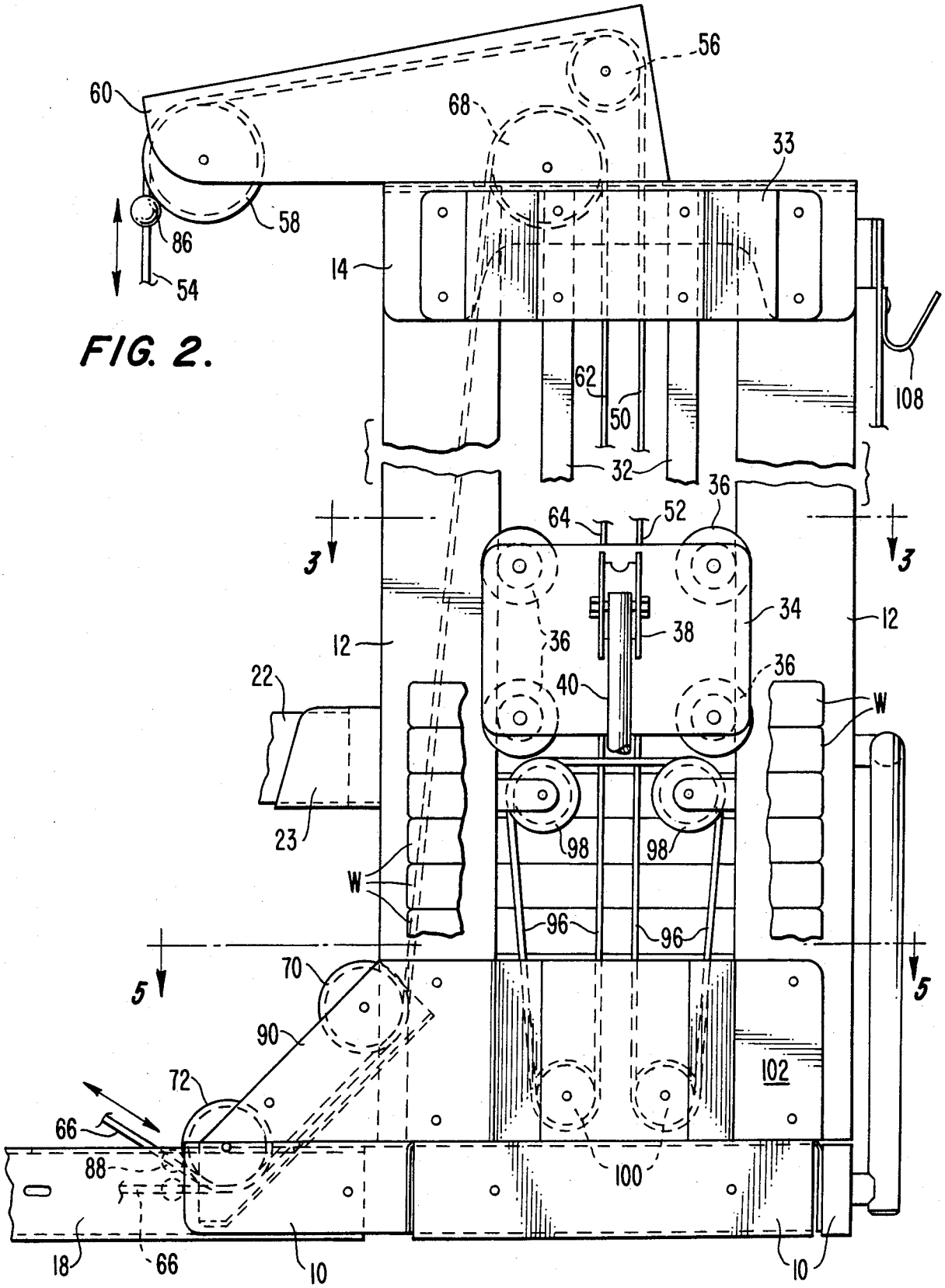
FIG. 2 is a side elevational view of a portion thereof, with parts broken away to show certain details.
Figure 3:
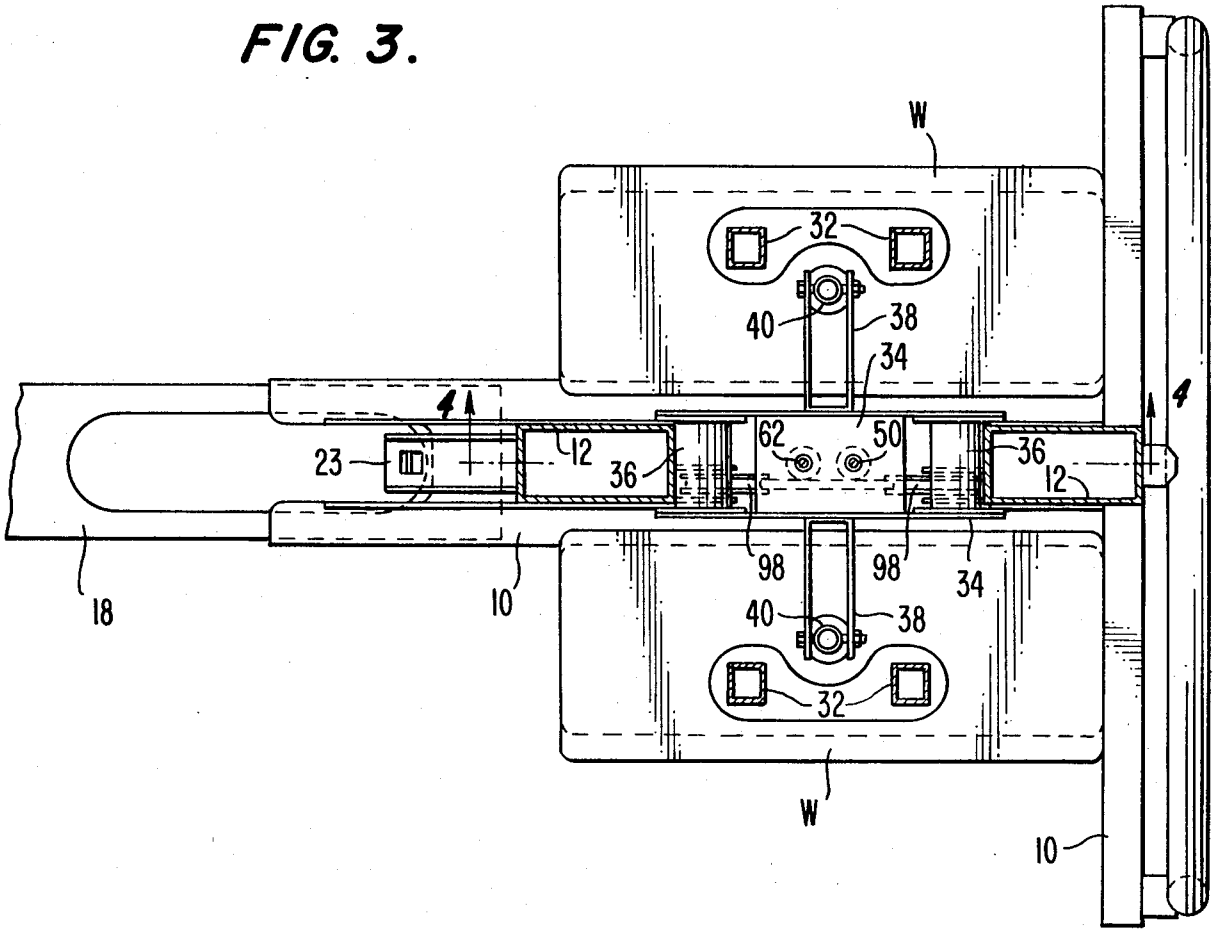
FIG. 3 is a sectional view thereof taken along line 3—3 of FIG. 2, with some parts removed for clarity.

Referring to FIGS. 1, 2 and 3, apparatus according to the invention comprises a generally vertical structure including a base 10 supporting a pair of parallel vertical carriage guides 12 interconnected at their upper ends by means of a cross-piece 14, and two pairs of vertical weight guides 32, secured by braces 33 to cross-piece 14, which guide two stacks of apertured weights W. A carriage 34, having journalled rollers 36, travels vertically along guides 12. A clevis 38 on each side of carriage 34 supports an apertured weight rod 40 which extends downwardly through aligned apertures in the stack of weights W. A weight selector pin (not shown), the handle 42 of which appears in FIG. 1, is inserted beneath a selected number of weights W to couple those weights to the weight rod 40 in a conventional manner known in the art so that lifting of the weight rod will lift the selected number of weights.

A bench assembly 16 is attached to base 10 and helps to stabilize the vertical structure. Bench assembly 16 includes a bench base 18 attached to base 10, a platform 20, a beam 22 supporting bench cushions 24, 26, and an exercise bar 28 attached to cables 30 which are operatively connected through the underside of platform 20 and bench base 18 to the weights W contained in the vertical portion of the apparatus. Beam 22 is supported at one end by a bracket 33 secured to front carriage guide 12. The particular bench structure illustrated and described here does not form a part of the invention, and many details of its construction therefore are not shown. The bench structure itself forms the subject of copending patent application Ser. No. 785,440, filed Oct. 8, 1985, which is commonly assigned. Any other type of stabilizing structure, bench or otherwise, may be attached to base 10, depending on the type of exercises to be performed using the cable arrangements of the invention described below. Instead of being free-standing as illustrated, the entire vertical structure of the apparatus may be affixed by suitable bracketry to a wall or other vertical supporting surface.

Lifting of carriage 34 is effected by a dual cable and pulley system. A first cable 50 is connected at its inner end 52 to carriage 34 and at its outer end 54 to a suitable handle or other appliance (not shown) which the user can grasp and pull. Cable 50 is trained over an upper pulley 56 and an outer pulley 58, both of which are enclosed in a cable guide or shroud 60. Upper pulley 56 defines beneath it a vertical run of the portion of cable 50 which is intermediate its inner and outer ends.

A second cable 62 is connected at its inner end 64 to carriage 34 and at its outer end 66 to a suitable mechanism or appliance for applying an exercise force. In the phantom position shown in FIG. 2, outer end 66 of cable 62 is operatively connected through bench base 18 to cables 30. In the solid position illustrated in FIG. 2, outer end 66 can be connected to any other type of appliance. Cable 62 is trained over an upper pulley 68, through front carriage guide 12, and around the lower pulleys 70, 72, which are embraced by a cable guide or shroud 90. Upper pulley 68 defines beneath it a vertical run for the portion of cable 62 intermediate its inner and outer ends.

Figure 4:
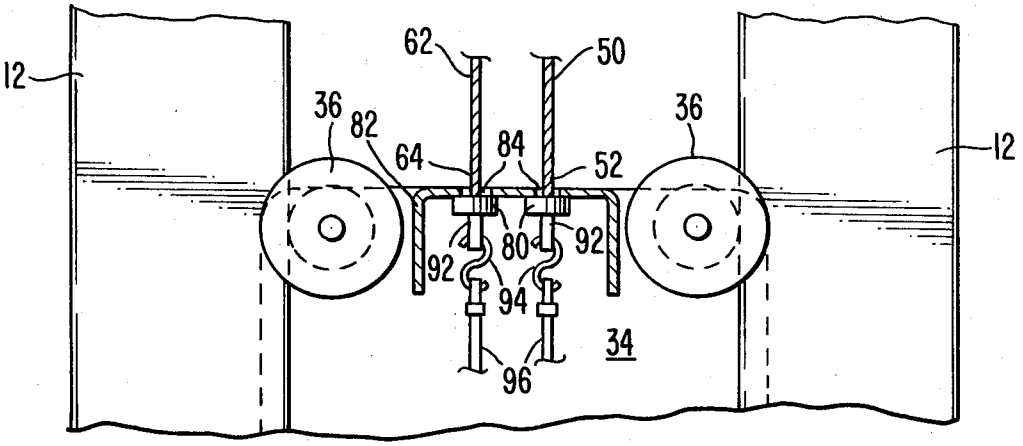
FIG. 4 is a detail sectional view of a portion of the apparatus.
Figure 5:
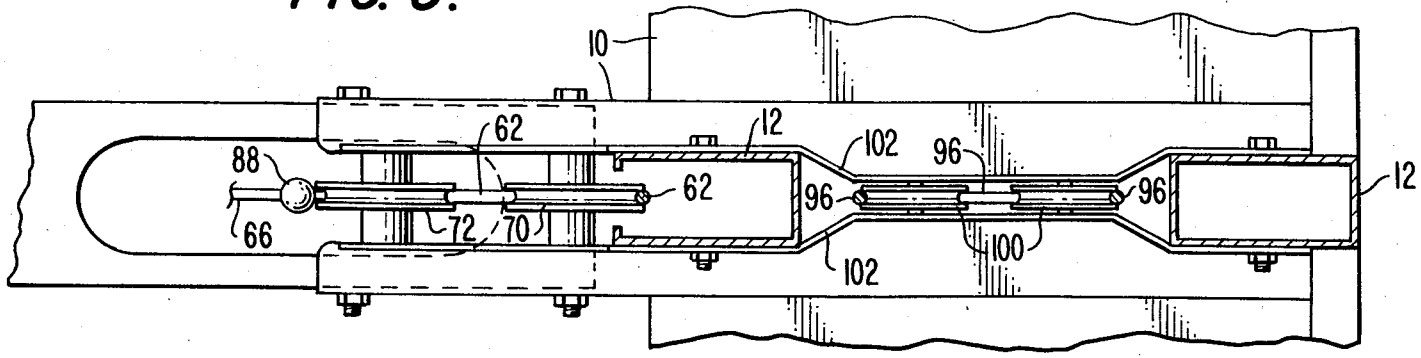
FIG. 5 is a sectional view of the apparatus taken along line 5—5 of FIG. 2.

Either of cables 50, 62 can be pulled to raise carriage 34 with the selected weights W attached thereto. A mechanism is provided for maintaining the unused cable taut and arresting its vertical run so that it neither pays out as the carriage 34 is lifted nor becomes entangled with the carriage or other portions of the apparatus. Referring to FIG. 4, the inner end 52, 64 of each cable is provided with carriage engaging means comprising an enlarged inner cable stop 80 affixed to the cable which engages the underside of an apertured member 82 of carriage 34. Apertures 84 in member 82 are sized to permit free passage of cables 50, 62, but prevent passage of stops 80. Outer cable stops 86, 88 respectively engage shrouds 60, 90 to prevent further retraction of cables 50, 62. Each cable stop commonly used in the art 86, 88 is a conventional cable stop comprising an enlarged spherical member fixed at one position along the cable. See, for example, Medart U.S. Pat. No. 931,699.

The inner ends of cables 50, 62 are provided with eyes 92. Eyes 92 receive S-hooks 94 which are attached to the ends of an elastic cord 96. Elastic cord 96 is looped around upper and lower pairs of fixed pulleys 98, 100 which respectively are journalled on carriage guides 12 and upstanding base flanges 102.

The operation of the apparatus now will be readily understood. When a pulling exercise force is to be applied, for example, to outer end 54 of cable 50, inner cable stop 80 on cable 50 will engage the underside of apertured member 82 on carriage 34, and lift carriage 34 along with the attached selected weights. Extension of cable 50 also will begin to stretch elastic cord 96, which is anchored at its other end to the inner end of cable 62. This will pull outer cable stop 88 against pulley 72 and shroud 90 and tension cable 62 so that its vertical run is arrested and remains stationary. Carriage 34 therefore rides up and down along guides 12 past the stationary vertical run of cable 62 without interference from cable 62. Similarly, when a pulling exercise force is to be applied to the outer end 66 of cable 62, the vertical run of cable 50 is arrested and maintained taut by elastic cord 96 with cable stop 86 wedged between pulley 58 and shroud 60. The spring rate of elastic cord 96 is relatively light, but chosen to be strong enough to support the weight of any handle or appliance normally left attached to the outer end 54 of cable 50 so that handle or appliance will not descend and interfere with the user when the carriage 34 is lifted by means of cable 62.

The apparatus also is provided with a number of items which enhance its appearance and facilitate its use. A shroud 104 (FIG. 1) surrounds the front and two sides of the weight stacks. A handle bar 106 is secured to base 10 at the front of the vertical structure. An accessory rack 108 is supported on rear carriage guide 12 and has hooks for hanging handles and other accessories.

It is to be understood that the above-described apparatus is but one example of the invention. It will be apparent to one of ordinary skill that modifications and changes may be made in the structure of the invention without departing from the true spirit and scope of the invention, which is defined by the appended claims. For example, single elastic cord 96 could be replaced by a pair of independent elastic cords, each of which is trained around a separate pulley system and anchored to base 10. Alternatively, elastic cord 96 could be replaced by another form of extensible and resilient biasing means for maintaining the unused cable in a taut condition. Other modifications will be apparent to one of ordinary skill.

I claim:

1. Physical exercising apparatus comprising:

a liftable carriage;

vertically extending carriage guide means for guiding the movement of said carriage;

resistance means operatively connected to said carriage for downwardly biasing and resisting lifting movement of said carriage; and a plurality of alternately usable lifting means operatively connected to said carriage for lifting said carriage against said resistance means, said lifting means comprising:

a cable having an inner end operatively connected to said carriage, an outer end to which a lifting force can be applied by a user, and an intermediate portion between said inner and outer ends;

upper cable guide means adjacent to top of said carriage guide means for guiding said cable and defining therebeneath a vertical run of said cable along said intermediate portion;

outer cable stop means on said cable for limiting downward movement of said cable along said vertical run;

cable tensioning means connected to the inner end of said cable for tensioning and arresting the vertical run of said cable during lifting and lowering of said carriage by another of said lifting means; and carriage engaging means on the inner end of said cable for engaging and lifting said carriage when a lifting force is applied to the outer end of said cable, said carriage engaging means allowing said carriage to freely move past the stationary vertical run of said cable when said carriage is lifted by another of said lifting means.

2. Physical exercising apparatus according to claim 1 wherein said carriage engaging means comprises an enlarged inner cable stop fixed to the inner portion of said cable, and said carriage comprises a lifting member having a cable-receiving aperture with a vertically disposed axis, said aperture sized to permit free passage of said cable but to prevent passage of said inner cable stop, and said cable disposed within said aperture with said inner cable stop below said aperture.

3. Physical exercising apparatus according to claim 2 wherein said cable tensioning means comprises an extensible element attached to the inner end of said cable, said extensible element having sufficient extensibility to permit full lifting movement of said carriage along said carriage guide means.

4. Physical exercising apparatus according to claim 3 wherein said extensible element comprises an elastic element having a fixed end, the opposite end of said elastic element attached to the inner end of said cable.

5. Physical exercising apparatus according to claim 4 wherein said upper cable guide means comprises a pulley and a cable guide embracing said pulley, and said outer cable stop means comprises an enlarged outer cable stop fixed to the outer portion of said cable outwardly of said vertical cable run and adjacent said cable guide when no lifting force is applied to the outer portion of said cable, said cable guide sized to prevent passage of said outer cable stop.

6. Physical exercising apparatus according to claim 5 wherein said resistance means comprises a stack of weights and weight selector means for coupling a selected number of said weights to said carriage.

7. Physical exercising apparatus comprising:

a liftable carriage;

vertically extending carriage guide means for guiding the movement of said carriage;

resistance means operatively connected to said carriage for downwardly biasing and resisting liftinge movement of said carriage; and a pair of alternately usable lifting means operatively connected to said carriage for lifting said carriage against said resistance means, each of said lifting means comprising:

a cable having an inner end operatively connected to said carriage, an outer end to which a lifting force can be applied by a user, and an intermediate portion between said inner and outer ends;

upper cable guide means adjacent the top of said carriage guide means for guiding said cable and defining therebeneath a vertical run of said cable along said intermediate portion;

outer cable stop means on said cable for limiting downward movement of said cable along said vertical run;

cable tensioning means connected to the inner end of said cable for tensioning and arresting the vertical run of said cable during lifting and lowering of said carriage by the other of said pair of lifting means; and carriage engaging means on the inner end of said cable for engaging and lifting said carriage when a lifting force is applied to the outer end of said cable, and allowing said carriage to freely move past the stationary vertical run of said cable when said carriage is lifted by the other of said pair of lifting means.

8. Physical exercising apparatus according to claim 7 wherein said carriage engaging means comprises an enlarged inner cable stop fixed to the inner portion of said cable, and said carriage comprises a lifting member having a pair of cable-receiving apertures each with a vertically disposed axis, each of said apertures sized to permit passage of one of said said cables but to prevent passage of said inner cable stop, and said cables disposed one within each of said apertures with said inner cable stops below said apertures.

9. Physical exercising apparatus according to claim 8 wherein said cable tensioning means comprises an extensible element attached to the inner end of said cable, said extensible element having sufficient extensibility to permit full lifting movement of said carriage along said carriage guide means.

10. Physical exercising apparatus according to claim 9 wherein said extensible element comprises an elastic element interconnecting the inner ends of said cables.

11. Physical exercising apparatus according to claim 10 wherein said cable tensioning means further comprises element guide means for guiding said elastic element between the inner ends of said cables.

12. Physical exercising apparatus according to claim 11 wherein said element guide means comprises a plurality of fixed sheaves around which said elastic element is looped.

13. Physical exercising apparatus according to claim 12 wherein said element guide means comprises a pair of laterally spaced lower sheaves and a pair of laterally spaced upper sheaves, said elastic element extending from the inner end of one of said cables down and around one of said lower pair of sheaves, up and over said upper pair of sheaves, down and around the other of said lower pair of sheaves, and up to the inner end of the other of said cables.

14. Physical exercising apparatus according to claim 11 wherein the upper cable guide means for one of said cables comprises an upper pulley and a cable guide embracing said upper pulley, and said outer cable stop means for said one cable comprises an enlarged outer cable stop fixed to the outer portion of said one cable outwardly of said vertical cable run and adjacent said cable guide when no lifting force is applied to the outer portion of said one cable, said cable guide sized to prevent passage of said outer cable stop.

15. Physical exercising apparatus according to claim 14 wherein said resistance means comprises a stack of weights and weight selector means for coupling a selected number of said weights to said carriage.

16. Physical exercising apparatus according to claim 14 wherein the upper cable guide means for the other of said cables comprises an upper pulley, further comprising lower cable guide means including a lower pulley adjacent the bottom of said carriage guide means for guiding said other cable from said upper cable guide means.

* * * * *